US012687328B2

(12) United States Patent
Kishida et al.

(10) Patent No.: US 12,687,328 B2
(45) Date of Patent: Jul. 21, 2026

(54) HEAT EXCHANGER AND REFRIGERATION CYCLE APPARATUS

(71) Applicant: Mitsubishi Electric Corporation, Tokyo (JP)

(72) Inventors: Nanami Kishida, Tokyo (JP); Yoji Onaka, Tokyo (JP); Rihito Adachi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 62 days.

(21) Appl. No.: 18/868,188

(22) PCT Filed: Jun. 1, 2022

(86) PCT No.: PCT/JP2022/022283

§ 371 (c)(1),
(2) Date: Nov. 22, 2024

(87) PCT Pub. No.: WO2023/233572

PCT Pub. Date: Dec. 7, 2023

(65) Prior Publication Data

US 2025/0327603 A1 Oct. 23, 2025

(51) Int. Cl.

| | |
|---|---|
| ***F25B 39/02*** | (2006.01) |
| ***F28D 1/04*** | (2006.01) |
| ***F28D 21/00*** | (2006.01) |

(52) U.S. Cl.

CPC ..... *F25B 39/02* (2013.01); *F28D 1/0417* (2013.01); *F28D 1/0435* (2013.01); *F28D 1/0452* (2013.01); *F28D 2021/0063* (2013.01)

(58) Field of Classification Search

CPC ..... F28D 2021/0063; F28D 1/0443; F28D 1/0452; F28D 1/0417; F28D 1/05391

See application file for complete search history.

(56) References Cited

U.S. PATENT DOCUMENTS 5,529,116 A * 6/1996 Sasaki ..... F28D 1/0435 165/145
2003/0066633 A1* 4/2003 Lee ..... F28D 1/05391 165/175

(Continued)

FOREIGN PATENT DOCUMENTS

JP H07-098162 A 4/1995
JP 2010-107103 A 5/2010

(Continued)

OTHER PUBLICATIONS

International Search Report and Written Opinion mailed on Aug. 9, 2022, received for PCT Application PCT/JP2022/022283, filed on Jun. 1, 2022, 10 pages including English Translation.

*Primary Examiner* — Lionel Nouketcha
(74) *Attorney, Agent, or Firm* — XSENSUS LLP

(57) ABSTRACT

A heat exchanger includes a leeward heat exchange unit disposed downstream in an air flow direction, a windward heat exchange unit, and a common header. The leeward heat exchange unit includes a first header, the windward heat exchange unit includes a second header, and, when the leeward heat exchange unit and the windward heat exchange unit each function as a condenser, the leeward heat exchange unit and the windward heat exchange unit include a first region in which refrigerant flowing into the first header flows against the air flow direction and flows into the second header, a second region in which the refrigerant flows parallel to the air flow direction and flows into the first header, and a third region in which the refrigerant flows against the air flow direction and flows into the second header.

8 Claims, 7 Drawing Sheets

(56) References Cited

U.S. PATENT DOCUMENTS

| | | | | |
|---|---|---|---|---|
| 2011/0056668 | A1* | 3/2011 | Taras | F28F 9/262 165/174 |
| 2014/0124183 | A1* | 5/2014 | Hwang | F25B 39/00 165/173 |
| 2015/0107286 | A1* | 4/2015 | Jin | F25B 13/00 62/324.6 |
| 2017/0122630 | A1* | 5/2017 | Okazaki | F25B 40/00 |
| 2019/0072335 | A1* | 3/2019 | Nakamura | F28F 1/02 |
| 2019/0078817 | A1* | 3/2019 | Nakamura | F28D 1/053 |
| 2021/0222893 | A1 | 7/2021 | Matsui et al. | |
| 2022/0018553 | A1* | 1/2022 | Akaiwa | F24F 1/0068 |

FOREIGN PATENT DOCUMENTS

| | | | | |
|---|---|---|---|---|
| JP | 2012-149845 | A | 8/2012 | |
| JP | 2019-027614 | A | 2/2019 | |
| JP | 2019-132582 | A | 8/2019 | |
| WO | 2019/239446 | A1 | 12/2019 | |
| WO | 2021/234953 | A1 | 11/2021 | |
| WO | WO-2021234961 | A1 * | 11/2021 | F28D 1/053 |

* cited by examiner

HEAT EXCHANGER AND REFRIGERATION CYCLE APPARATUS

CROSS-REFERENCE TO RELATED APPLICATION

This application is a national stage application, pursuant to 35 U.S.C. § 371, of International Patent Application No. PCT/JP2022/022283, filed Jun. 1, 2022, the entire contents of which are incorporated herein by reference.

TECHNICAL FIELD

The present disclosure relates to a heat exchanger and a refrigeration cycle apparatus configured to exchange heat of refrigerant.

BACKGROUND ART

A known heat exchanger includes, in an air flow direction, a windward heat exchange unit and a leeward heat exchange unit that are connected in series. In such a heat exchanger, to increase the performance of the heat exchanger, when the heat exchanger functions as a condenser, refrigerant is caused to flow in a direction opposite to the flow direction of the air flowing into the heat exchanger, in a downstream region of the heat exchanger in which subcooled liquid flows (for example, refer to Patent Literature 1).

CITATION LIST

Patent Literature

Patent Literature 1: Japanese Unexamined Patent Application Publication No. 7-98162

SUMMARY OF INVENTION

Technical Problem

Such a heat exchanger has a problem in that the heat exchange performance is reduced since the refrigerant flows in a parallel flow to the air flow direction in a superheated gas region when the heat exchanger functions as a condenser.

The present disclosure has been made in view of the above circumstances and has an object to provide a heat exchanger and a refrigeration cycle apparatus that have improved heat exchange performance.

Solution to Problem

A heat exchanger according to an embodiment of the present disclosure includes a leeward heat exchange unit disposed downstream in an air flow direction, a windward heat exchange unit disposed further upstream than the leeward heat exchange unit in the air flow direction, and a common header. The leeward heat exchange unit includes a leeward heat transfer tube row including heat transfer tubes arranged and spaced in a direction crossing the air flow direction and a first header connected to a lower end portion of the leeward heat transfer tube row, the windward heat exchange unit includes a windward heat transfer tube row including heat transfer tubes arranged and spaced in a direction crossing the air flow direction and a second header connected to a lower end portion of the windward heat transfer tube row, the common header is connected to an upper end portion of the leeward heat transfer tube row and an upper end portion of the windward heat transfer tube row and connects the leeward heat transfer tube row and the windward heat transfer tube row, and, when the leeward heat exchange unit and the windward heat exchange unit each function as a condenser, the leeward heat exchange unit and the windward heat exchange unit include a first region in which refrigerant flowing into the first header flows against the air flow direction and flows into the second header, a second region in which the refrigerant passing through the first region and flowing into the second header flows parallel to the air flow direction and flows into the first header, and a third region in which the refrigerant passing through the second region and flowing into the first header flows against the air flow direction and flows into the second header.

Advantageous Effects of Invention

The heat exchanger according to an embodiment of the present disclosure includes the first region, the second region, and the third region when functions as the condenser. In the first region, the refrigerant flows against the air flow direction. In the second region, the refrigerant passing through the first region flows parallel to the air flow direction. In the third region, the refrigerant passing through the second region flows against the air flow direction.

Thus, when the heat exchanger functions as the condenser, unlike the related art, the refrigerant flows against the air flow direction also in the first region that is a superheated gas region, in addition to the third region that is a subcooled liquid region. Thus, the heat exchange performance of the heat exchanger is improved.

DESCRIPTION OF EMBODIMENTS

Figure 1:
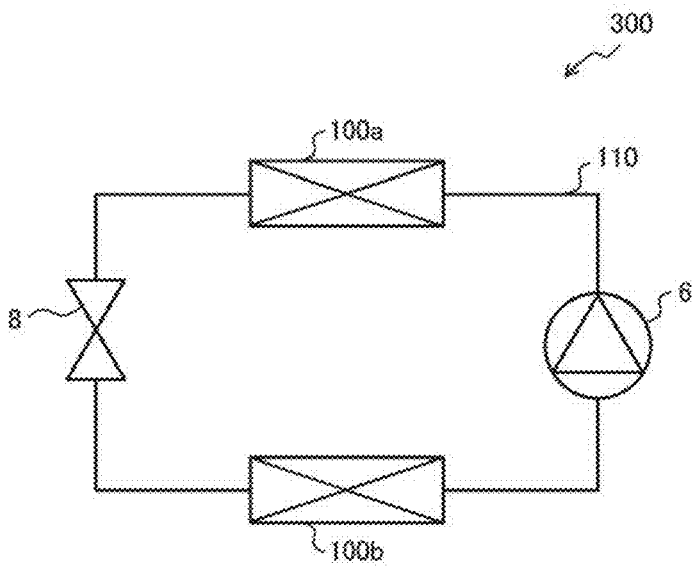
FIG. 1 is a schematic view of a refrigerant circuit of an air-conditioning apparatus according to Embodiment 1.

A heat exchanger of an air-conditioning apparatus according to an embodiment will be described with reference to the drawings. Note that, in the drawings, the same constituents are denoted by the same reference signs, and redundant description is given only when required. The present disclosure can encompass every possible combination of configurations that can be combined, among the configurations described in the following embodiments. In the drawings, the relationship of the sizes of the components sometimes differs from the relationship of the sizes of actual components. The forms of the constituents represented in the entire description are merely examples, and the constituents are not limited to the forms described in the description. In particular, the combination of the constituents is not limited to only the combination in each of the embodiments, and a constituent described in one embodiment can be applied to another embodiment.

Embodiment 1

FIG. 1 is a schematic view of a refrigerant circuit 110 of an air-conditioning apparatus 300 according to Embodiment 1.

The refrigerant circuit 110 includes a compressor 6, a condenser 100*a*, an expansion valve 8, and an evaporator 100*b*.

In the air-conditioning apparatus 300, an outdoor heat exchanger functions as the condenser 100*a*, and an indoor heat exchanger functions as the evaporator 100*b* during a cooling operation. The outdoor heat exchanger functions as the evaporator 100*b*, and the indoor heat exchanger functions as the condenser 100*a* during a heating operation.

The compressor 6 compresses sucked refrigerant and discharges the refrigerant. Here, although the compressor 6 is not particularly limited to the following, the capacity of the compressor 6 may be changed by appropriately changing an operation frequency by using, for example, an inverter circuit. Note that the capacity of the compressor 6 represents the amount of the refrigerant to be delivered per unit time.

The condenser 100*a* exchanges heat between the refrigerant discharged from the compressor 6 and air. The condenser 100*a* condenses the refrigerant to be liquefied.

The expansion valve 8 reduces the pressure of refrigerant to expand the refrigerant. For example, when the expansion valve 8 is an electronic expansion valve, the opening degree of the expansion valve 8 is regulated in accordance with an instruction of, for example, a controller, which is not illustrated.

The evaporator 100*b* exchanges heat between air and refrigerant. The evaporator 100*b* evaporates the refrigerant to be gasified.

The single-phase gas refrigerant discharged from the compressor 6 is condensed into single-phase liquid in the condenser 100*a*. The refrigerant that has been condensed into the single-phase liquid in the condenser 100*a* passes through the expansion valve 8 and is turned into two-phase gas-liquid refrigerant. The two-phase gas-liquid refrigerant that has passed through the expansion valve 8 passes through the evaporator 100*b* and evaporates into single-phase gas again. The single-phase gas refrigerant that has passed through the evaporator 100*b* flows into the compressor 6.

Figure 2:
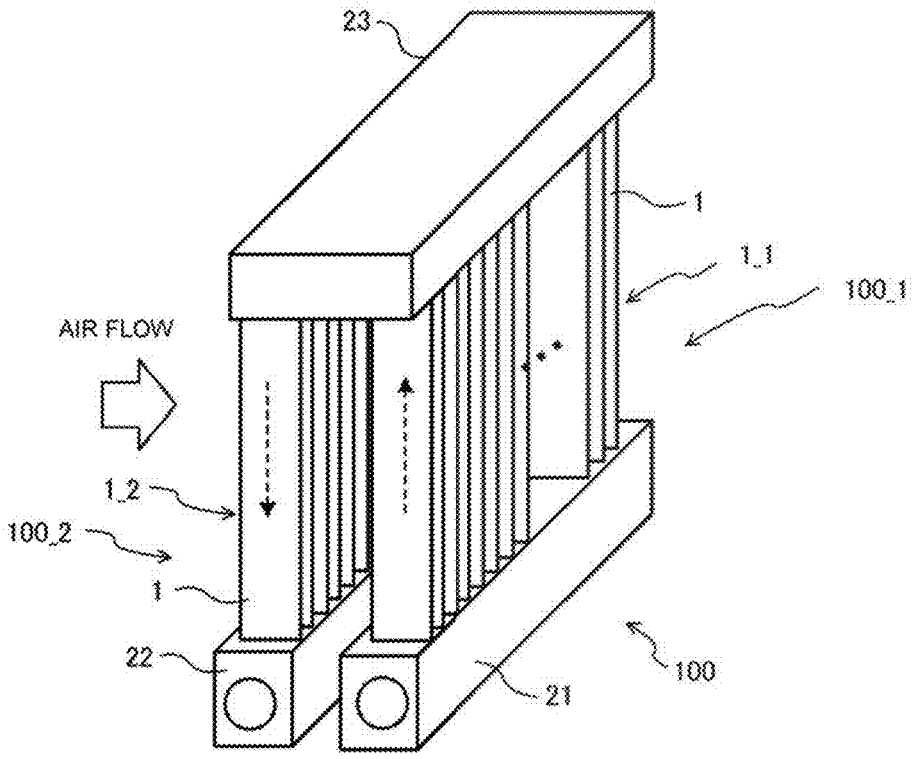
FIG. 2 is a perspective view of a heat exchanger according to Embodiment 1.

FIG. 2 is a perspective view of a heat exchanger 100 according to Embodiment 1. The heat exchanger 100 illustrated in FIG. 2 is applied to the condenser 100*a*. In FIG. 2, a flow direction of the air flowing into the heat exchanger 100 is, as indicated by the hollow arrow, a direction from the left to the right of the paper sheet of FIG. 2. In addition, the broken-line arrows each indicate the flow direction of the refrigerant when the heat exchanger 100 functions as the condenser 100*a*.

As FIG. 2 illustrates, the heat exchanger 100 includes a leeward heat exchange unit 100_1 and a windward heat exchange unit 100_2. The leeward heat exchange unit 100_1 is disposed downstream in the air flow direction. The windward heat exchange unit 100_2 is disposed further upstream than the leeward heat exchange unit 100_1 in the air flow direction.

The leeward heat exchange unit 100_1 includes a leeward heat transfer tube row 1_1 including heat transfer tubes 1 arranged and spaced in a direction crossing the air flow direction and a first header 21 connected to a lower end portion of the leeward heat transfer tube row 1_1. The first header 21 distributes refrigerant into the heat transfer tubes of the leeward heat transfer tube row 1_1 or causes portions of the refrigerant flowing from the leeward heat transfer tube row 1_1 to merge with one another. The heat transfer tubes 1 of the leeward heat transfer tube row 1_1 allow the refrigerant to flow vertically.

The windward heat exchange unit 100_2 includes a windward heat transfer tube row 1_2 including heat transfer tubes 1 arranged and spaced in a direction crossing the air flow direction and a second header 22 connected to a lower end portion of the windward heat transfer tube row 1_2. The second header 22 distributes refrigerant into the heat transfer tubes of the windward heat transfer tube row 1_2 or causes portions of the refrigerant flowing from the windward heat transfer tube row 1_2 to merge with one another. The heat transfer tubes 1 of the windward heat transfer tube row 1_2 allow the refrigerant to flow vertically.

The leeward heat exchange unit 100_1 and the windward heat exchange unit 100_2 share a common header 23 connected to an upper end portion of the leeward heat transfer tube row 1_1 and an upper end portion of the windward heat transfer tube row 1_2 and connecting the leeward heat transfer tube row 1_1 and the windward heat transfer tube row 1_2. The common header 23 allows refrigerant to move in a row direction between the leeward heat transfer tube row 1_1 and the windward heat transfer tube row 1_2.

Here, the air flow direction and the flow direction of the refrigerant are defined as follows. The air flow direction is defined as a direction from the left to the right of the paper sheet of the figure. The refrigerant in the first header 21 flows into the common header 23 through the leeward heat transfer tube row 1_1. The refrigerant that has flowed into the common header 23 moves in the row direction of the heat exchanger 100 and flows into the windward heat transfer tube row 1_2. The refrigerant that has flowed into the windward heat transfer tube row 1_2 flows into the second header 22. In this case, the flow of the refrigerant is directed from the right to the left of the paper sheet of the figure, that is, in a direction opposite to the air flow direction. At this point, the flow of the refrigerant is defined as flowing against the air flow direction.

In the case where the air flow direction is the direction from the left to the right of the paper sheet of the figure in a similar manner, the refrigerant in the second header 22 flows into the windward heat transfer tube row 1_2. The refrigerant that has flowed into the windward heat transfer tube row 1_2 moves in the row direction in the common header 23 and flows into the first header 21 through the leeward heat transfer tube row 1_1. In this case, the refrigerant flows from the left to the right of the paper sheet of the figure, that is, in the same direction as the air flow direction. At this point, the flow of the refrigerant is defined as flowing parallel to the air flow direction.

Figure 3:
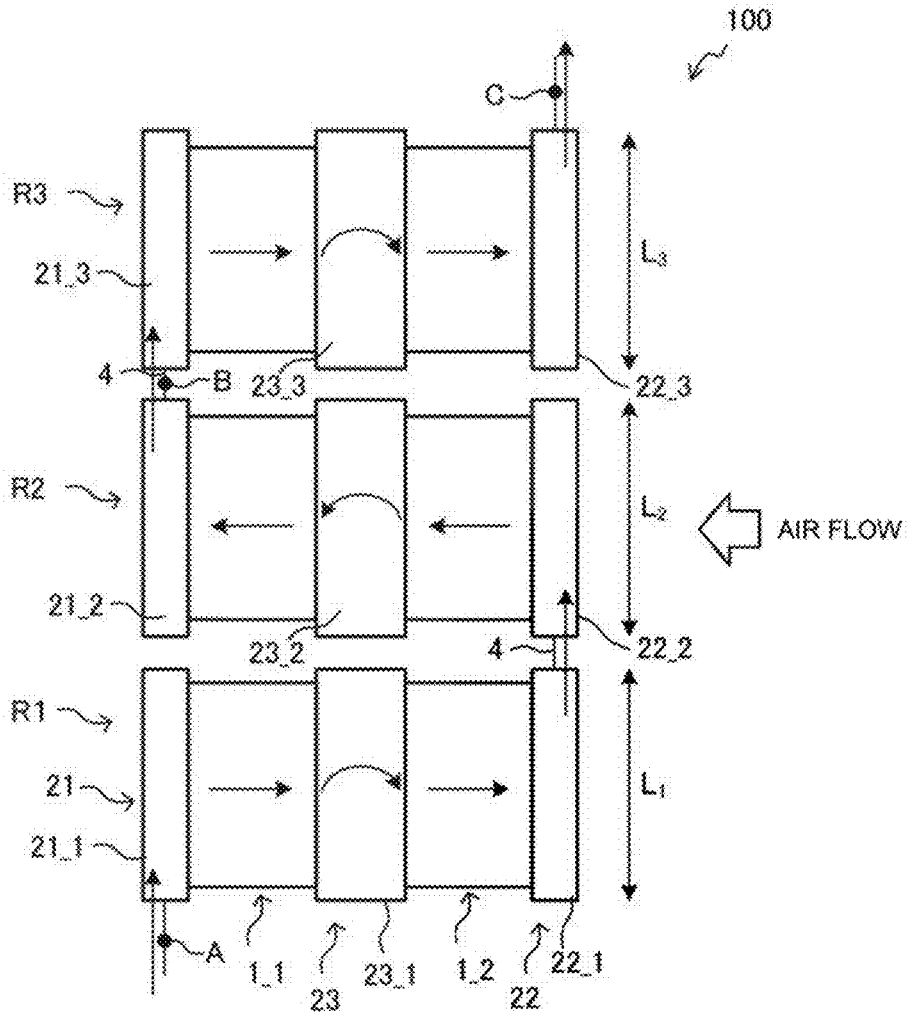
FIG. 3 illustrates a state of the flow of refrigerant in the heat exchanger according to Embodiment 1.

FIG. 3 illustrates a state of the flow of the refrigerant in the heat exchanger 100 according to Embodiment 1. FIG. 3 illustrates a state of the flow of the refrigerant when the refrigerant that has flowed into the first header 21 flows out from the second header 22. In FIG. 3, the arrows each indicate the flow of the refrigerant, and the hollow arrow indicates the air flow direction.

When the heat exchanger 100 according to Embodiment 1 functions as the condenser, the leeward heat exchange row 1_1 and the windward heat exchange row 1_2 include a first region R1, a second region R2, and a third region R3.

The first region R1 is a region in which the refrigerant that has flowed into the first header 21 flows against the air flow direction and flows into the second header 22. The second region R2 is a region in which the refrigerant that has passed through the first region R1 and has flowed into the second header 22 flows parallel to the air flow direction and flows into the first header 21. The third region R3 is a region in which the refrigerant that has passed through the second region R2 and has flowed into the first header 21 flows against the air flow direction and flows into the second header 22.

As FIG. 3 illustrates, the first header 21 includes a first header 21_1 in the first region R1, a first header 21_2 in the second region R2, and a first header 21_3 in the third region R3. The second header 22 includes a second header 22_1 in the first region R1, a second header 22_2 in the second region R2, and a second header 22_3 in the third region R3. The common header 23 includes a common header 23_1 in the first region R1, a common header 23_2 in the second region R2, and a common header 23_3 in the third region R3.

The first header 21, the second header 22, and the common header 23 are each divided into three parts in FIG. 3 but are not necessarily divided into such three parts. For example, a partition plate provided inside one header may divide the inside of the one header into plural regions.

In FIG. 3, the first region R1, the second region R2, and the third region R3 are connected in series to one another by connection pipes 4. Specifically, the second header 22_1 is connected in series to the second header 22_2 by the connection pipe 4. The first header 21_2 is connected in series to the first header 21_3 by the connection pipe 4.

Note that the first region R1, the second region R2, and the third region R3 may be separated from one another by partition plates in the first header 21, the second header 22, and the common header 23.

In FIG. 3, the length of the leeward heat exchange unit 100_1 in the first region R1 in the longitudinal direction of the first header 21_1 and the length of the windward heat exchange unit 100_2 in the first region R1 in the longitudinal direction of the second header 22_1 are each defined as $L_1$. The length of the leeward heat exchange unit 100_1 in the second region R2 in the longitudinal direction of the first header 21_2 and the length of the windward heat exchange unit 100_2 in the second region R2 in the longitudinal direction of the second header 22_2 are each defined as $L_2$. The length of the leeward heat exchange unit 100_1 in the third region R3 in the longitudinal direction of the first header 21_3 and the length of the windward heat exchange unit 100_2 in the third region R3 in the longitudinal direction of the second header 22_3 are each defined as $L_3$.

In FIG. 3, a point A, a point B, and a point C correspond to a point A, a point B, and a point C in FIG. 4, which will be described later.

Figure 4:
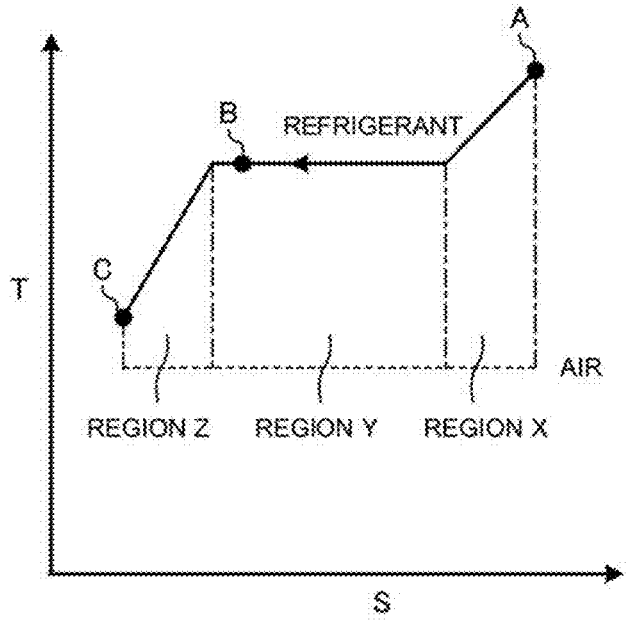
FIG. 4 illustrates a state of the refrigerant flowing in the heat exchanger according to Embodiment 1.

FIG. 4 illustrates a state of the refrigerant flowing in the heat exchanger 100 according to Embodiment 1. In FIG. 4, the vertical axis represents temperature T, and the horizontal axis represents entropy S. In addition, in FIG. 4, the arrow indicates a direction of change of the refrigerant when the heat exchanger 100 functions as the condenser.

Usually, when the heat exchanger 100 functions as the condenser, refrigerant first in a state of superheated gas flows into the heat exchanger 100, is brought into a two-phase gas-liquid state and then brought into a subcooled liquid state, and flows out. At this time, a region in which the refrigerant is the superheated gas is defined as a region X, a region in which the refrigerant is in the two-phase gas-liquid state is defined as a region Y, and a region in which the refrigerant is in the subcooled liquid state is defined as a region Z.

In Embodiment 1, $L_1$, $L_2$, and $L_3$ in FIG. 3 are determined such that the states of the refrigerant at the points A, B, and C in FIG. 4 are achieved at the points A, B, and C in FIG. 3. Here, the point A represents the temperature T and the entropy S just before the refrigerant flows into the region X. The point B represents the temperature T and the entropy S just before the refrigerant flows out of the region Y and just before the refrigerant flows into the third region R3. The point C represents the temperature T and the entropy S just after the refrigerant has flowed out of the region Z.

$L_1$ is preferably determined such that the refrigerant in form of superheated gas flowing in the region X flows inside the first header 21_1 and the second header 22_1. $L_3$ is preferably determined such that the refrigerant in form of subcooled liquid flowing in the region Z flows inside the first header 21_3 and the second header 22_3. In the heat exchanger 100 of Embodiment 1, $L_1$, $L_2$, and $L_3$ are set such that the flows of the refrigerant in the region X and the region Y in which the temperature of the refrigerant changes are each a counter flow against the air flow direction.

The region X and the region Z are each a sensible heat region. The sensible heat region is a region in which the temperature of the refrigerant changes due to the heat exchange in the heat exchanger 100. The region Y is a latent heat region in which the temperature of the refrigerant does not change even when heat is exchanged in the heat exchanger 100. In a case of heat exchange in the same amount, compared with the latent heat region, a larger difference in temperature is required in the sensible heat region; thus, in the heat exchanger 100, the refrigerant is caused to flow against the air flow direction in the first region R1 and the third region R3 that are the latent heat regions. Thus, the heat exchange performance is improved.

The refrigerant flowing in the first region R1 includes the superheated gas, the refrigerant flowing in the second region R2 is the two-phase gas-liquid refrigerant, and the refrigerant flowing in the third region R3 includes the subcooled liquid.

In a case of using a refrigerant mixture, the temperature changes also in the second region R2 in which the two-phase gas-liquid refrigerant flows, also when the heat exchanger 100 functions as the evaporator. When the heat exchanger 100 functions as the evaporator, in most cases, the two-phase gas-liquid refrigerant flows into and passes through the evaporator to be turned into single-phase gas. Also when the heat exchanger 100 functions as the evaporator by using, for example, a variable path, the heat exchanger 100 may be configured such that the refrigerant also flows in a counter flow against, in a parallel flow to, and in a counter flow against the air flow direction as in the case of the condenser. Thus, the evaporation performance of the heat exchanger 100 can also be improved.

According to Embodiment 1, when the heat exchanger 100 functions as the condenser, there can be provided the heat exchanger 100 in which, unlike the related art, the refrigerant also flows against the air flow direction in the first region R1 that is a superheated gas region, in addition to the third region R3 that is a subcooled liquid region. In the second region R2 that is the latent heat region in which sufficient heat exchange is achieved even with a small temperature difference, the two-phase gas-liquid refrigerant is caused to flow parallel to the air flow direction. As described above, the refrigerant is caused to flow against the air flow direction when in the subcooled liquid state and the superheated gas state, that is, in the sensible heat regions in which a large temperature difference is required. Thus, the heat exchange performance of the heat exchanger 100 is improved.

Embodiment 2

Figure 5:
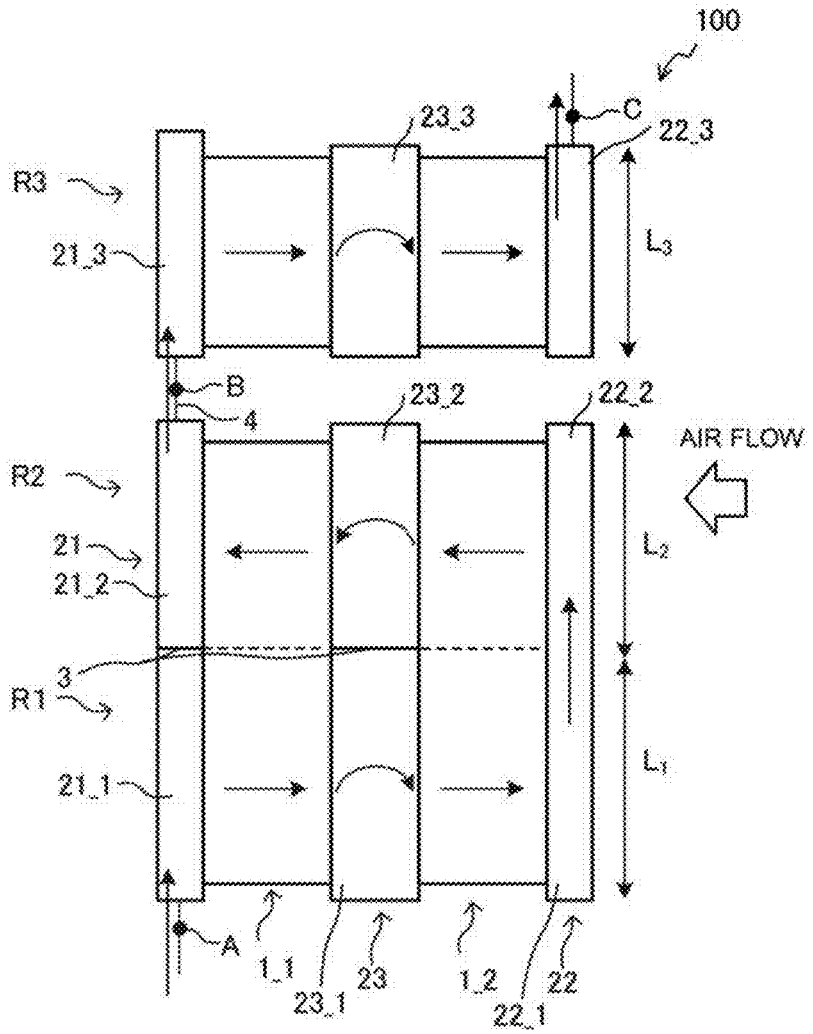
FIG. 5 illustrates a state of the flow of refrigerant in a heat exchanger of an air-conditioning apparatus according to Embodiment 2.

FIG. 5 illustrates a state of the flow of the refrigerant in a heat exchanger 100 of an air-conditioning apparatus 300 according to Embodiment 2. FIG. 5 illustrates a state of the flow of the refrigerant when the refrigerant that has flowed into a first header 21 flows out from a second header 22. In FIG. 5, the arrows each indicate the flow of the refrigerant, and the hollow arrow indicates the air flow direction.

Figure 6:
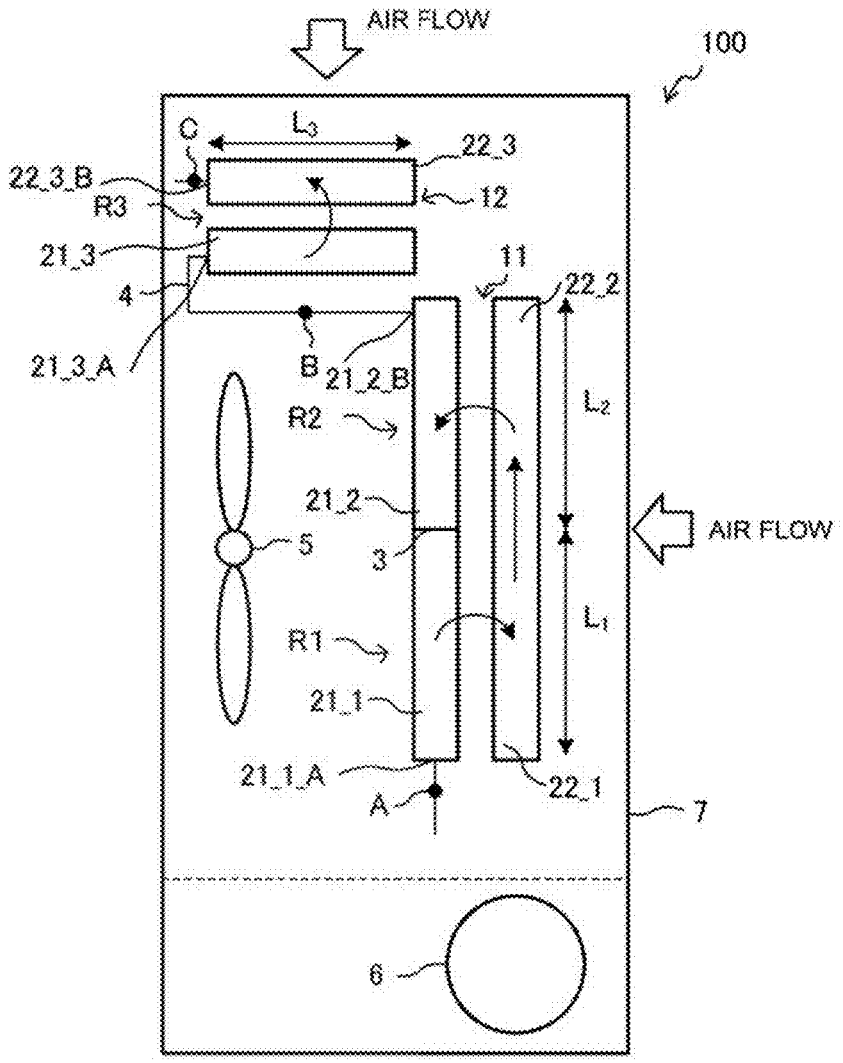
FIG. 6 illustrates an arrangement of first headers and second headers of the heat exchanger in the air-conditioning apparatus according to Embodiment 2.

FIG. 6 illustrates an arrangement of first headers 21 and second headers 22 of the heat exchanger 100 in the air-conditioning apparatus 300 according to Embodiment 2. A common header 23 and heat transfer tubes 1 are illustrated in FIG. 5 but are omitted and not illustrated in FIG. 6. In FIG. 6, the arrows each indicate the flow of the refrigerant, and the hollow arrows each indicate the air flow direction.

As an example of the heat exchanger 100 including three regions, the heat exchanger 100 including two heat exchangers, that is, a first heat exchanger 11 and a second heat exchanger 12 is given in Embodiment 2. The first heat exchanger 11 includes a first header 21_1, a second header 22_1, a common header 23_1, a first header 21_2, a second header 22_2, and a common header 23_2, and heat transfer tubes 1 connected to these headers. In addition, the second heat exchanger 12 includes a first header 21_3, a second header 22_3, and a common header 23_3, and heat transfer tubes 1 connected to these headers.

As FIG. 6 illustrates, an outdoor-unit housing 7 houses a fan 5, a compressor 6, the first heat exchanger 11, and the second heat exchanger 12.

The outdoor-unit housing 7 is a side-flow housing whose planar shape is a rectangle. The compressor 6 compresses refrigerant and discharges high-pressure gas refrigerant. The fan 5 delivers the air, for heat exchange, to the first heat exchanger 11 and the second heat exchanger 12.

The first heat exchanger 11 and the second heat exchanger 12 are arranged in an L shape such that the first heat exchanger 11 and the second heat exchanger 12 surround the fan 5.

As FIG. 6 illustrates, the first heat exchanger 11 includes a first region R1 and a second region R2. The second heat exchanger 12 includes a third region R3.

The first heat exchanger 11 includes the first header 21_1 in the first region R1 and the first header 21_2 in the second region R2. A partition plate 3 separating the first region R1 and the second region R2 is provided between the first header 21_1 and the first header 21_2.

In addition, as FIG. 5 illustrates, the first heat exchanger 11 includes the common header 23_1 in the first region R1 and the common header 23_2 in the second region R2. A partition plate 3 separating the first region R1 and the second region R2 is provided between the common header 23_1 and the common header 23_2.

The second heat exchanger 12 includes the third region R3. The second heat exchanger 12 includes the first header 21_3 in the third region R3, the second header 22_3 in the third region R3, and the common header 23_3 in the third region R3.

The third region R3 is a region in which the subcooled liquid flows, and, when a length Ls of heat exchange units in the longitudinal direction in the third region R3 is set excessively large, the refrigerant in form of superheated gas may flow even into the second region R2. In this case, an effect of improving the heat exchange performance is reduced by causing the flow of the refrigerant to be against the air flow direction in the first region R1. In addition, a decrease in a region into which the superheated gas refrigerant and the two-phase gas-liquid refrigerant whose pressure losses are larger than that of the subcooled liquid refrigerant flow, causes an increase in the pressure loss, which leads to reduction in the heat exchange performance.

In Embodiment 2, $(L_1+L_2)/2>L_3$ holds when $L_1$ is the length of the first region R1 in the longitudinal direction, $L_2$ is the length of the second region R2 in the longitudinal direction, and $L_3$ is the length of the third region R3 in the longitudinal direction. The sum of, in the first heat exchanger 11, the length $L_1$ of heat exchange units in the first region R1 in the longitudinal direction and the length $L_2$ of heat exchange units in the second region R2 in the longitudinal direction is larger than the length $L_3$ of the heat exchange units in the third region R3 in the longitudinal direction in the second heat exchanger 12. Further, $L_2>L_1$ holds in Embodiment 2.

The first header 21_1 has a refrigerant inlet 21_1_A through which refrigerant flows in. The first header 21_2 has a refrigerant outlet 21_2_B through which the refrigerant that has flowed in through the refrigerant inlet 21_1_A flows out.

The first header 21_3 has a refrigerant inlet 21_3_A through which the refrigerant that has flowed out through the refrigerant outlet 21_2_B flows in. The second header 22_3 has a refrigerant outlet 22_3_B through which the refrigerant flows out.

The refrigerant outlet 21_2_B and the refrigerant inlet 22_3_A are connected by a connection pipe 4. The refrigerant inlet 21_3_A is provided in one end portion of the first header 21_3 in the third region R3 that is farther from the refrigerant outlet 21_2_B than is the other end portion of the first header 21_3.

The refrigerant that has flowed into the first heat exchanger 11 through the refrigerant inlet 21_1_A of the first header 21_1 first flows against the air flow direction in the first region R1. The refrigerant that has flowed through the first region R1 flows into the second header 22 in the first region R1 and flows parallel to the air flow direction in the second region R2.

The refrigerant that has flowed through the second region R2 flows into the first header 21_2 and flows out through the refrigerant outlet 21_2_B. The refrigerant that has flowed out through the refrigerant outlet 21_2_B then passes through the connection pipe 4 and flows into the refrigerant inlet 21_3_A of the first header 21_3 in the third region R3 of the second heat exchanger 12.

The refrigerant that has flowed into the refrigerant inlet 21_3_A flows against the air flow direction in the third region R3 and flows out of the second heat exchanger 12.

Note that the heat exchanger 100 of Embodiment 2 is also applicable to a housing other than the side-flow housing. For example, plural heat exchangers 100 may be arranged on four sides such that the plural heat exchangers 100 surround the fan 5, in a top-flow outdoor-unit housing 7 in which the air sucked through a side of the housing is blown out from a top portion of the housing.

Figure 7:
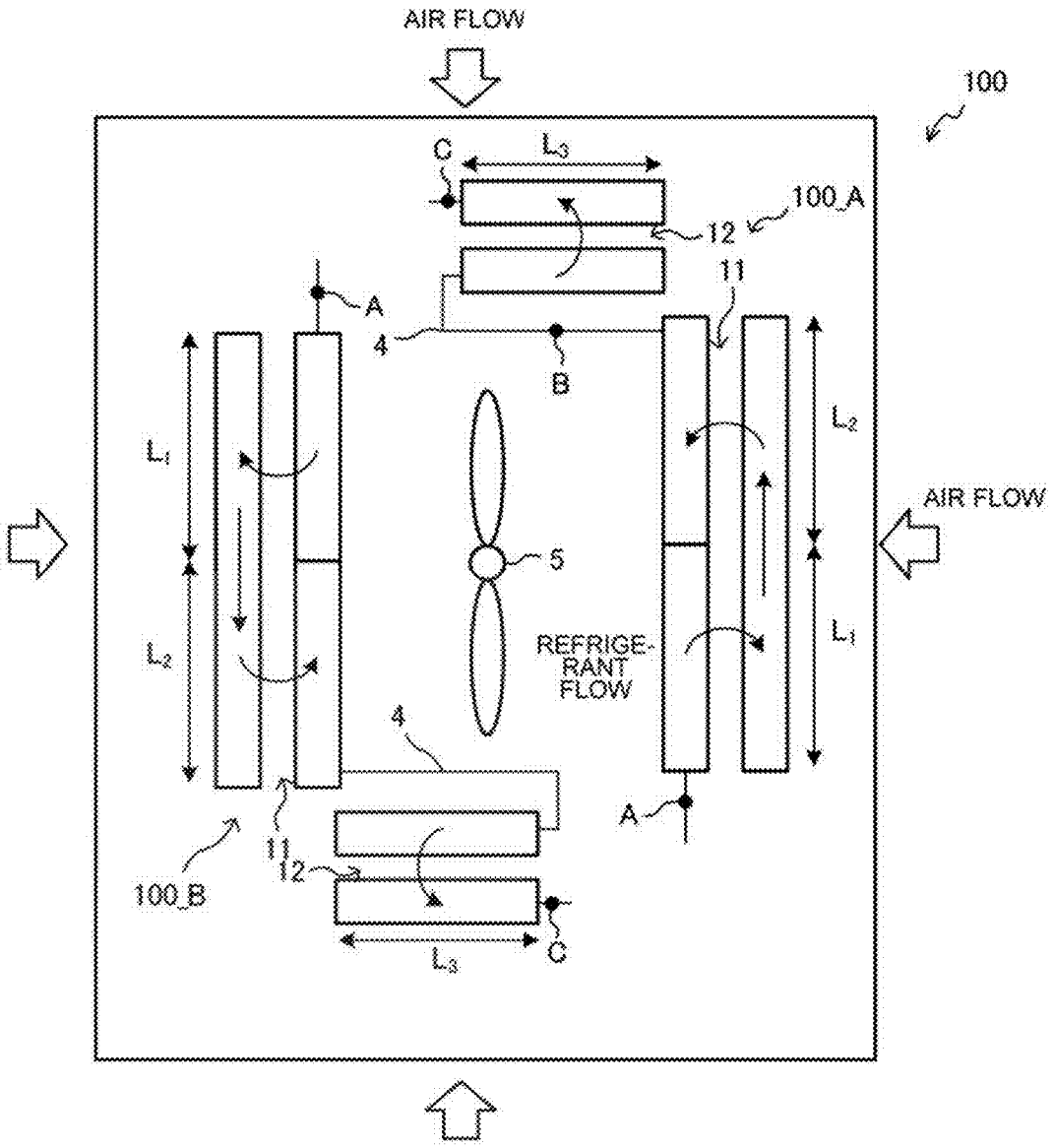
FIG. 7 illustrates a state in which two first heat exchangers and two second heat exchangers according to Embodiment 2 are arranged on four sides in an outdoor-unit housing such that the first and second heat exchangers surround a fan.

FIG. 7 illustrates a state in which two heat exchangers 100_A and 100_B according to Embodiment 2 are arranged on four sides in the outdoor-unit housing 7 such that the heat exchangers 100_A and 100_B surround the fan 5. In FIG. 7, the common header 23 and the heat transfer tubes 1 illustrated in FIG. 5 are omitted and not illustrated. In FIG. 7, the arrows each indicate the flow of the refrigerant, and the hollow arrows each indicate the air flow direction.

As FIG. 7 illustrates, there are provided the two heat exchangers 100_A and 100_B each including the first heat exchanger 11 and the second heat exchanger 12. The heat exchanger 100_A and the heat exchanger 100_B are arranged such that the heat exchanger 100_A and the heat exchanger 100_B surround the fan 5.

As in FIG. 6, the first heat exchanger 11 and the second heat exchanger 12 of the heat exchanger 100_A are arranged in an L shape such that the first heat exchanger 11 and the second heat exchanger 12 surround the fan 5. The first heat exchanger 11 and the second heat exchanger 12 of the heat exchanger 100_B are arranged in an L shape such that the first heat exchanger 11 and the second heat exchanger 12 surround the fan 5.

<Advantageous Effects>

In the heat exchanger 100 of Embodiment 2, the first region R1 and the second region R2 are included in one first heat exchanger 11, and space saving is thereby possible; thus, a heat transfer area can be further increased.

In addition, in the heat exchanger 100 of Embodiment 2, the first heat exchanger 11 includes the first region R1 and the second region R2. That is, as an example of a method for switching the flows of the refrigerant, from a counter flow to a parallel flow, against or to the air flowing into the heat exchanger 100, a method in which the partition plate 3 for dividing the inside space of the first header 21 is adopted. Thus, the flow switch of the refrigerant can be achieved with minimum possible influence on the structure of the heat exchanger 100, and the increase in manufacturing cost can be kept down.

When an end portion of the header of the first heat exchanger 11 and an end portion of the header of the second heat exchanger 12 that are close to each other are mutually connected by the connection pipe 4, structural restrictions regarding, for example, pressure loss and the angle of bending are likely to exert an influence. In an attempt to connect the headers of the first heat exchanger 11 and the second heat exchanger 12 that are close to each other, the pressure loss is increased when the headers are mutually connected by bending the connection pipe 4 at a sharp angle. In addition, since, depending on the diameter of the connection pipe 4, more than or equal to a certain bend radius is required, or a component for connection of the connection pipe 4 is mounted on a header end portion, the distance between the first heat exchanger 11 and the second heat exchanger 12 is increased. As a result, the housing equipped with the heat exchanger 100 including the first heat exchanger 11 and the second heat exchanger 12 is increased in size.

In addition, in an attempt to install the heat exchanger 100 including the first heat exchanger 11 and the second heat exchanger 12 without changing the size of the housing, there is no choice but to reduce the heat transfer area of the heat exchanger 100 due to structural restriction regarding, for example, pipes. As a result, the mounting area of the heat exchanger 100 is reduced, and the heat exchange performance is reduced.

In the heat exchanger 100 of Embodiment 2, the refrigerant outlet 21_2_B and the refrigerant inlet 21_3_A are connected by the connection pipe 4. The refrigerant inlet 21_3_A is provided in the one end portion of the first header 21_3 in the third region R3, which is farther from the refrigerant outlet 21_2_B than is the other end portion of the first header 21_3.

Thus, the arrangement can be made with the maximum possible heat transfer area of the first heat exchanger 11 and the second heat exchanger 12, the mounting area of the heat exchanger 100 can be increased, and improvement in the heat exchange performance can thus be expected. As a result, by installing the heat exchanger 100 of Embodiment 2, the heat exchanger 100 can exhibit its ability to the maximum possible.

Embodiment 3

Figure 8:
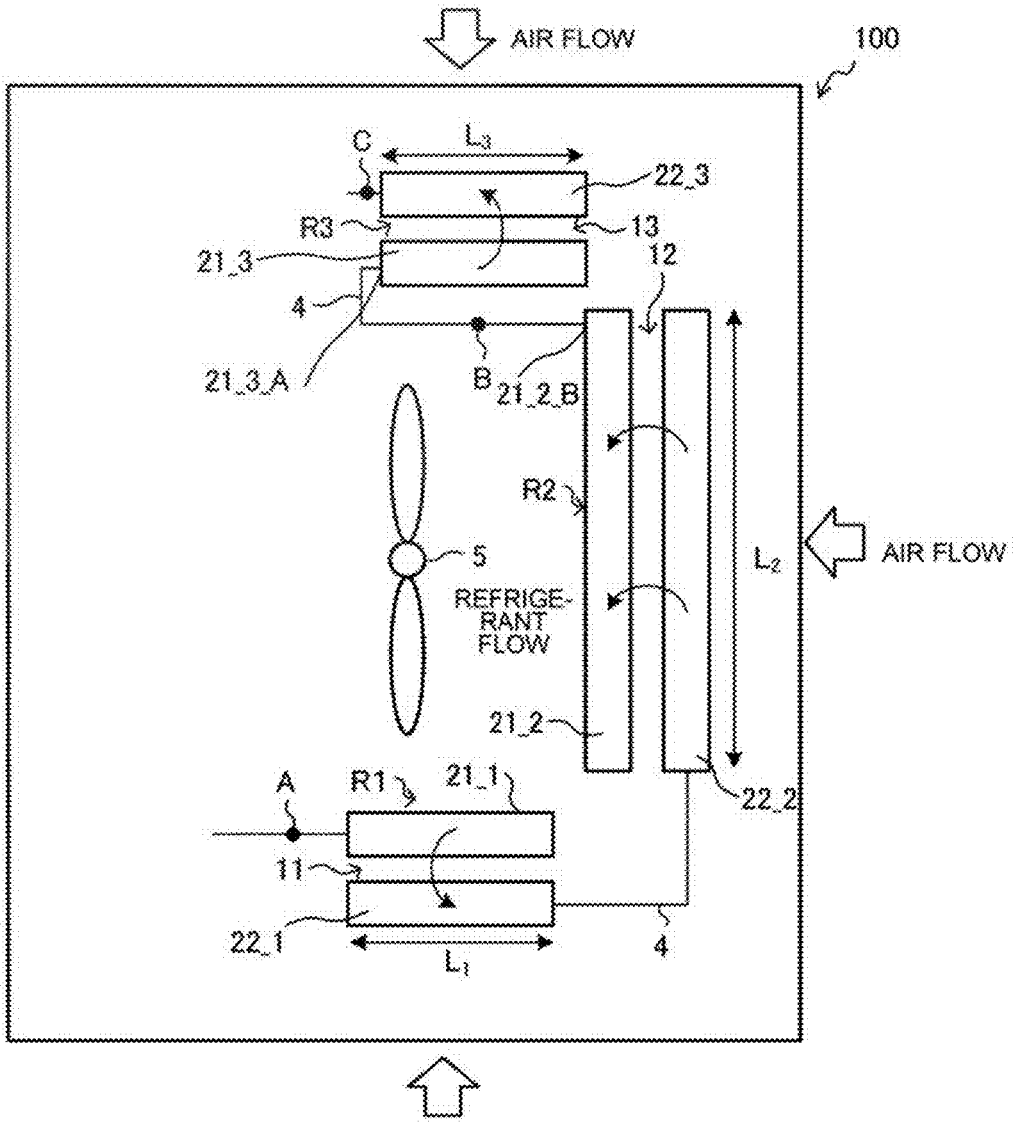
FIG. 8 illustrates a state in which a heat exchanger according to Embodiment 3 is disposed inside an outdoor-unit housing.

FIG. 8 illustrates a state in which a heat exchanger 100 according to Embodiment 3 is disposed inside an outdoor-unit housing 7. The outdoor-unit housing 7 is a top-flow housing. In FIG. 8, a common header 23 corresponding to that illustrated in FIG. 5 is omitted and not illustrated. In FIG. 8, the arrows each indicate the flow of the refrigerant, and the hollow arrows each indicate the air flow direction.

As FIG. 8 illustrates, the heat exchanger 100 according to Embodiment 3 includes a first heat exchanger 11, a second heat exchanger 12, and a third heat exchanger 13. The first heat exchanger 11, the second heat exchanger 12, and the third heat exchanger 13 are arranged in a U shape such that the first heat exchanger 11, the second heat exchanger 12, and the third heat exchanger 13 surround a fan 5.

The first heat exchanger 11 includes a first region R1, and refrigerant flows in a counter flow against the air flow direction. The second heat exchanger 12 includes a second region R2, and the refrigerant flows in a parallel flow to the air flow direction. The third heat exchanger 13 includes a third region R3, and the refrigerant flows in a counter flow against the air flow direction.

A second header 22_1 in the first region R1 on the windward side of the first heat exchanger 11 is connected to a second header 22_2 in the second region R2 on the windward side of the second heat exchanger 12 by a connection pipe 4. A first header 21_2 in the second region R2 on the leeward side of the second heat exchanger 12 is connected to a first header 21_3 in the third region R3 on the leeward side of the third heat exchanger 13 by a connection pipe 4.

The connection between the first heat exchanger 11 and the second heat exchanger 12 is achieved by connecting the second header 22_1 on the outer side to the second header 22_2 on the outer side by the connection pipe 4. The connection between the second heat exchanger 12 and the third heat exchanger 13 is achieved by connecting the first header 21_2 on the inner side to the first header 21_3 on the inner side by the connection pipe 4.

That is, when the first heat exchanger 11 in which the refrigerant flows in a counter flow and the second heat exchanger 12 in which the refrigerant flows in a parallel flow are connected by the connection pipe 4, the second header 22_1 on the outer side and the second header 22_2 on the outer side in the second region R2 are connected.

When the second heat exchanger 12 in which the refrigerant flows in a parallel flow and the third heat exchanger 13 in which the refrigerant flows in a counter flow are connected by the connection pipe 4, the first header 21_2 on the inner side and the first header 21_3 on the inner side are connected.

In connecting the headers on the inner side of the housing to each other, some space is required when the connection is made by bending the pipe as in the case where the headers on the outer side are connected to each other. As FIG. 8 illustrates, a refrigerant inlet 21_3_A is provided in one end portion of the first header 21_3 in the third region R3 that is farther from a refrigerant outlet 21_2_B than is the other end portion of the first header 21_3. Thus, in the heat exchanger 100 of Embodiment 3, space saving of the heat exchanger 100 can be achieved, and improvement in the heat exchange performance and the maximization of the mounting area as possible can thus be expected.

The embodiments are given as examples and are not intended to limit the scope of the claims. The embodiments can be implemented in various other forms, and various omissions, replacements, and changes can be made without departing from the gist of the embodiments. The embodiments and their modifications are included in the scope and the gist of the embodiments.

REFERENCE SIGNS LIST

1: heat transfer tube, 1_1: leeward heat transfer tube row, 1_2: windward heat transfer tube row, 3: partition plate, 4: connection pipe, 5: fan, 6: compressor, 7: outdoor-unit housing, 8: expansion valve, 11: first heat exchanger, 12: second heat exchanger, 13: third heat exchanger, 21: first header, 21_1: first header in first region, 21_1_A: refrigerant inlet, 21_2: first header in second region, 21_2_B: refrigerant outlet, 21_3: first header in third region, 21_3_A: refrigerant inlet, 22: second header, 22_1: second header in first region, 22_2: second header in second region, 22_3: second header in third region, 22_3_B: refrigerant outlet, 23: common header, 23_1: common header in first region, 23_2: common header in second region, 23_3: common header in third region, 100, 100_A, 100_B: heat exchanger, 100_1: leeward heat exchange unit, 100_2: windward heat exchange unit, 100*a*: condenser, 100*b*: evaporator, 110: refrigerant circuit, 300: air-conditioning apparatus, R1: first region, R2: second region, R3: third region, $L_1$: length of heat exchange unit in first region in longitudinal direction, $L_2$: length of heat exchange unit in second region in longitudinal direction, $L_3$: length of heat exchange unit in third region in longitudinal direction, T: temperature, S: entropy

The invention claimed is:

1. A heat exchanger comprising:

a leeward heat exchange unit disposed downstream in an air flow direction;

a windward heat exchange unit disposed further upstream than the leeward heat exchange unit in the air flow direction; and a common header, the leeward heat exchange unit including a leeward heat transfer tube row including heat transfer tubes arranged and spaced in a direction crossing the air flow direction and a first header connected to a lower end portion of the leeward heat transfer tube row, the windward heat exchange unit including a windward heat transfer tube row including heat transfer tubes arranged and spaced in a direction crossing the air flow direction and a second header connected to a lower end portion of the windward heat transfer tube row, the common header being connected to an upper end portion of the leeward heat transfer tube row and an upper end portion of the windward heat transfer tube row and connecting the leeward heat transfer tube row and the windward heat transfer tube row, when the leeward heat exchange unit and the windward heat exchange unit each function as a condenser, the leeward heat exchange unit and the windward heat exchange unit including a first region in which refrigerant flowing into the first header flows against the air flow direction and flows into the second header, a second region in which the refrigerant passing through the first region and flowing into the second header flows parallel to the air flow direction and flows into the first header, and a third region in which the refrigerant passing through the second region and flowing into the first header flows against the air flow direction and flows into the second header, the leeward heat exchange unit and the windward heat exchange unit being each divided up among a first heat exchanger including the first region and the second region and a second heat exchanger including the third region, the first header of the first heat exchanger having a refrigerant outlet through which the refrigerant flows out, the first header of the second heat exchanger having a refrigerant inlet through which the refrigerant flowing out through the refrigerant outlet flows in, the heat exchanger further comprising a connection pipe connecting the refrigerant outlet and the refrigerant inlet, the first heat exchanger and the second heat exchanger being arranged in an L shape in plan view, the refrigerant inlet being provided in one end portion of the first header of the second heat exchanger that is farther from the refrigerant outlet than the other end portion of the first header of the second heat exchanger.

2. The heat exchanger of claim 1, wherein, when a length of the leeward heat exchange unit in the first region in a longitudinal direction of the first header and a length of the windward heat exchange unit in the first region in a longitudinal direction of the second header are each defined as L, a length of the leeward heat exchange unit in the second region in the longitudinal direction of the first header and a length of the windward heat exchange unit in the second region in the longitudinal direction of the second header are each defined as $L_2$, and a length of the leeward heat exchange unit in the third region in the longitudinal direction of the first header and a length of the windward heat exchange unit in the third region in the longitudinal direction of the second header are each defined as $L_3$, $(L_1+L_2)/2>L_3$ holds.

3. The heat exchanger of claim 2, wherein $L_2>L_1$ holds.

4. The heat exchanger of claim 1, wherein the common header and the first header each include a partition plate separating the first region and the second region.

5. The heat exchanger of claim 1, wherein
the refrigerant flowing in the first region includes superheated gas, and the refrigerant flowing in the third region includes subcooled liquid.

6. A heat exchanger comprising
a side-flow housing that houses the heat exchanger of claim 1.

7. A heat exchanger comprising
a top-flow housing that houses the heat exchanger of claim 1.

8. A refrigeration cycle apparatus comprising
the heat exchanger of claim 1.

* * * * *